United States Patent [19]

Auckenthaler

[11] 4,242,949

[45] Jan. 6, 1981

[54] APPARATUS FOR MAKING PACKAGING SLEEVES

[75] Inventor: Robert Auckenthaler, Schaffhausen, Switzerland

[73] Assignee: SIG - Schweizerische Industrie-Gesellschaft, Neuhausen am Rheinfall, Switzerland

[21] Appl. No.: 32,479

[22] Filed: Apr. 23, 1979

[30] Foreign Application Priority Data

Apr. 21, 1978 [CH] Switzerland ..... 4346785/78

[51] Int. Cl.[3] ..... B31B 1/52

[52] U.S. Cl. ..... 493/295; 493/276

[58] Field of Search ..... 93/59 ES, 59 CE, 12 R, 93/12 C, 44, 44.1 R, 94 R, 77 R, 81 R, 94 PS, 39.1 P

[56] References Cited

U.S. PATENT DOCUMENTS

| | | | |
|---|---|---|---|
| 1,628,120 | 5/1927 | Cooper | 93/44 |
| 3,530,773 | 9/1970 | Kühnle et al. | 93/12 R |
| 3,765,308 | 10/1973 | Auckenthaler | 93/59 ES X |
| 3,776,105 | 12/1973 | Coates | 93/59 ES X |

FOREIGN PATENT DOCUMENTS

| | | | |
|---|---|---|---|
| 1063890 | 8/1959 | Fed. Rep. of Germany | 93/12 R |
| 1254005 | 11/1967 | Fed. Rep. of Germany | 93/12 R |

*Primary Examiner*—James F. Coan

*Attorney, Agent, or Firm*—Spencer & Kaye

[57] ABSTRACT

The apparatus includes a mandrel, about which blank sheets are successively folded to obtain packaging sleeves. On one face the mandrel has a recess which extends in the length dimension of the mandrel and in which a first pressing shoe is arranged for reciprocation parallel to the mandrel length. A face of the first pressing shoe complements a mandrel face to a continuous folder face. A second pressing shoe cooperates with the first pressing shoe in pressing and bonding together overlapping edge zones of the blank folded about the mandrel. The first and the second pressing shoes are—as they press the overlapping edge zones—movable as a unit together with the packaging sleeve relative to the mandrel parallel to its length dimension. In this manner the packaging sleeve is stripped from the mandrel, while the adhesive between the overlapping edge zones sets as the stripping takes place.

13 Claims, 5 Drawing Figures

APPARATUS FOR MAKING PACKAGING SLEEVES

BACKGROUND OF THE INVENTION

This invention relates to an apparatus for making packaging sleeves from sheet blanks. Each blank is folded about a mandrel and the overlapping edge zones of the blank are pressed and bonded to one another and subsequently the obtained packaging sleeve is stripped from the mandrel. Such an arrangement, which provides a longitudinal seam on the packaging sleeves has been long known. After stripping the bonded sleeve from the mandrel, the sleeve is advanced to stations of a packing machine.

According to a known arrangement of the above-outlined type, such as disclosed, for example, in U.S. Pat. No. 3,530,773, the operational phase including the stripping of the packaging sleeve from the mandrel is particularly circumstantial because the tools (such as pliers or the like) used for stripping can damage the sleeve which firmly surrounds the mandrel, since these tools engage only a relatively small portion of the sleeve and thus exert a large local force thereon. This difficulty is often increased by the fact that excess quantities of the adhesive may solidify on the mandrel and thus the adhesion of the sleeve to the mandrel is further increased.

A further disadvantage of known arrangements of the above-outlined type resides in their slow operation because of a waiting period between forming the sleeve and removing it from the mandrel to allow setting of the adhesive to ensure a satisfactory bond between the overlapping edge zones of the packaging sleeve.

SUMMARY OF THE INVENTION

It is an object of the invention to provide an improved apparatus of the above-outlined type from which the discussed disadvantages are eliminated.

This object and others to become apparent as the specification progresses, are accomplished by the invention, according to which, briefly stated, the mandrel has a recess extending along the length dimension of the mandrel and receiving a first pressing shoe which is longitudinally displaceable with respect to the mandrel and which complements the cross-sectional shape of the mandrel to a continuous folding face. A second pressing shoe cooperates with the first pressing shoe by urging overlapping edge zones of the packaging sleeve to one another. There is further provided a conveying device for moving the pressing shoes, while they grasp the packaging sleeve, away from the mandrel, thus stripping the sleeve from the mandrel. Thereafter the pressing shoe release the packaging sleeve and then return to the mandrel for a new cycle of operation.

The disadvantages discussed above are eliminated by the invention because the packaging sleeve is, during stripping, firmly held between the longitudinal pressing device (formed of the two pressing shoes) along the entire adhesive or sealing surface of the edge zones of the sleeve, whereby the danger of ruptures or the like is eliminated. Further, the stripping operation may start practically immediately subsequent to the compression of the edge zones, because the setting of the adhesive or the like can be allowed to occur while the stripping operation is in progress.

DESCRIPTION OF THE PREFERRED EMBODIMENTS

Figure 1:
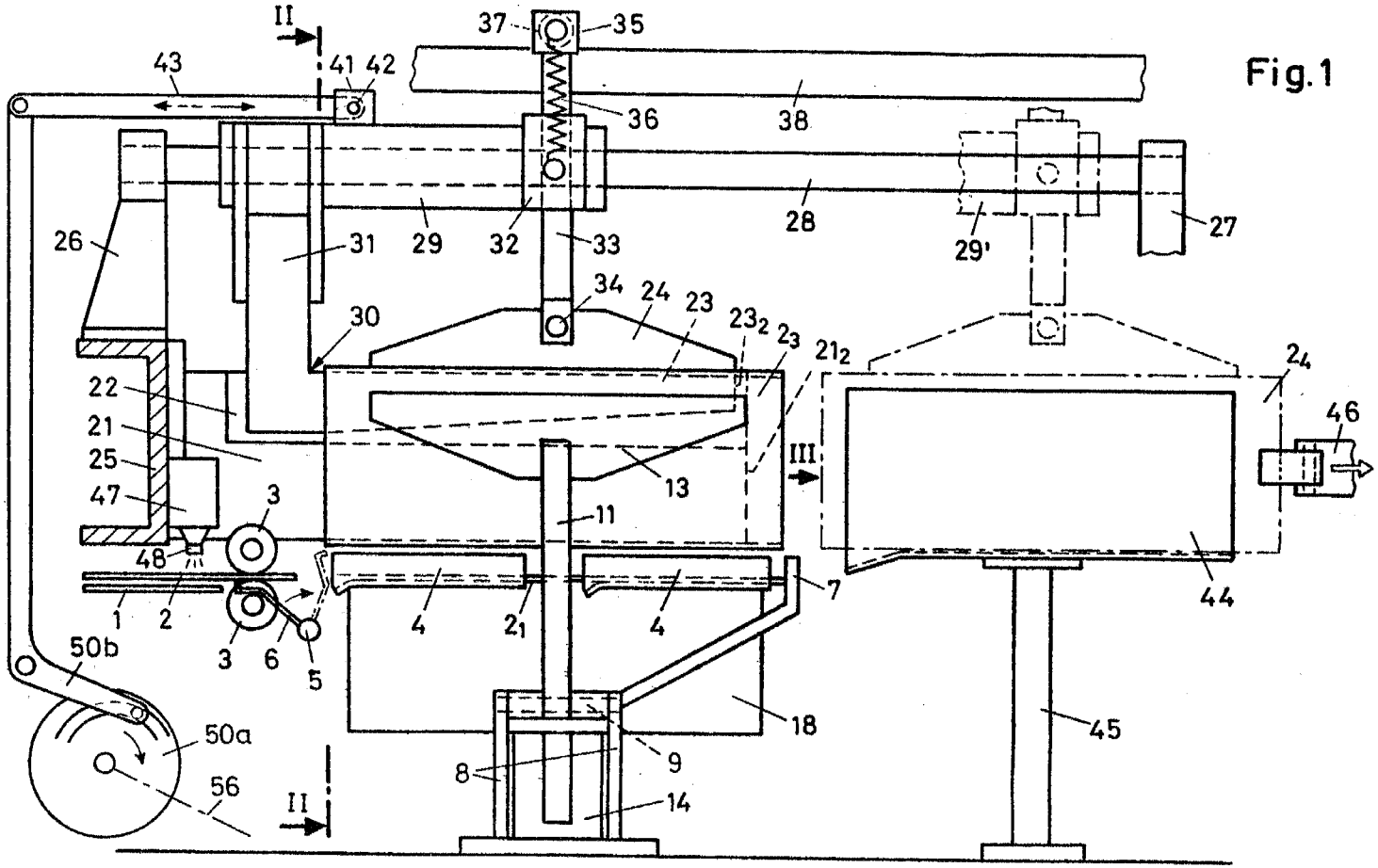
FIG. 1 is a schematic side elevational view of a preferred embodiment.
Figure 2:
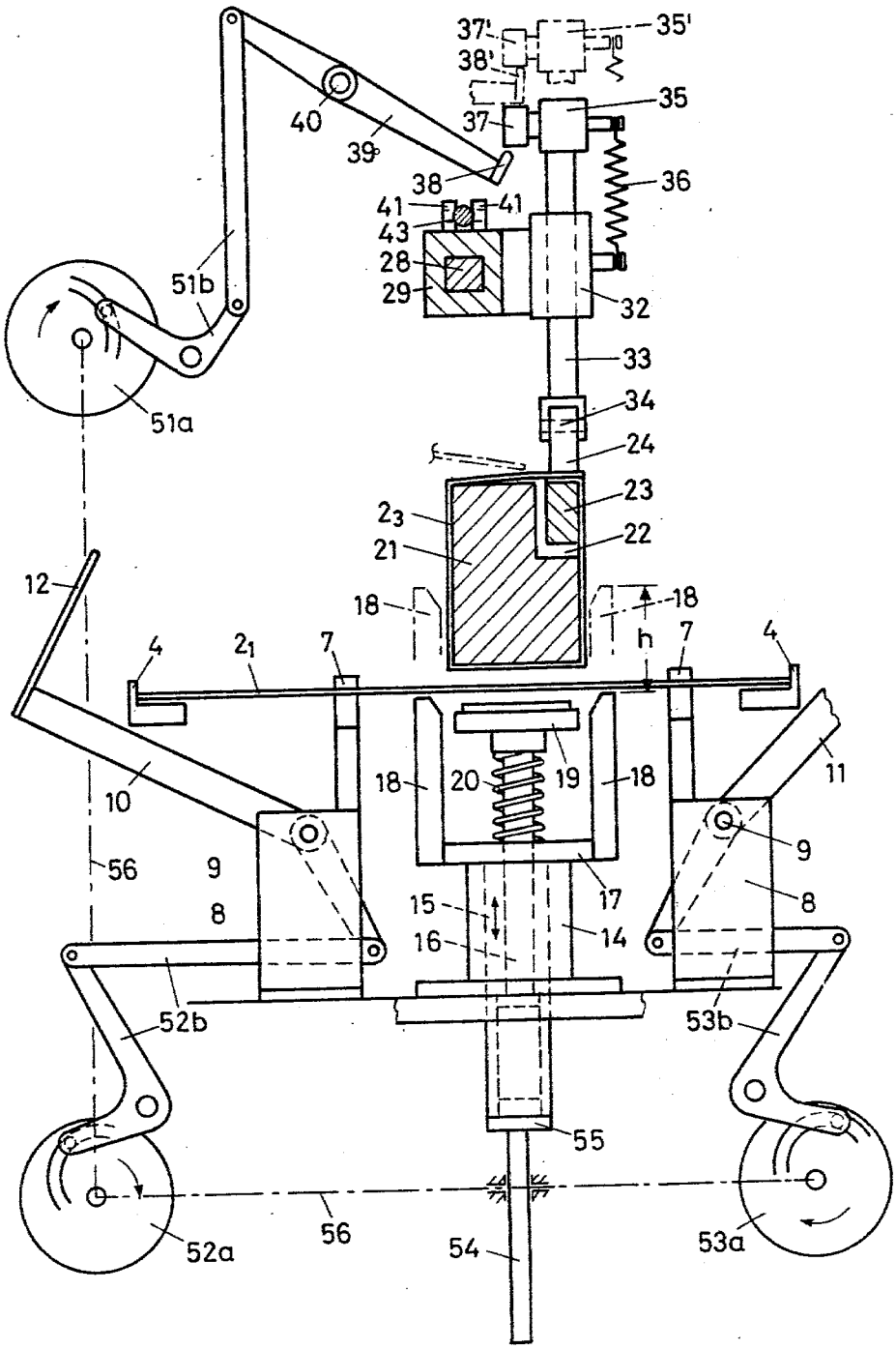
FIG. 2 is a sectional view taken along line II—II of FIG. 1.

Turning now to FIGS. 1 and 2, the apparatus illustrated therein has a supply track 1 for feeding rectangular cardboard blanks 2. At the discharge end of the track 1 there are provided feed rolls 3 which advance the blanks 2 while they glide on two pairs of support rails 4 secured to the machine frame. An arm 6 pivotally supported on the machine frame at 5, pushes each blank 2 to a pair of abutments 7, where the blank 2 stops as illustrated at $2_1$. The abutments 7 are mounted on two support brackets 8 which carry the respective shaft 9 of two pivotal arms 10 and 11 which, in turn, are provided at their free ends with folder wings 12 and 13. Between the two support brackets 8 there is arranged a vertically oriented guide sleeve 14 in which there is guided a vertically reciprocating tube 15 which, in turn, guides a ram 16 in its interior. On its upper end, the tube 15 carries a plate 17, from opposite edges of which there extend upwardly two vertical folder panels 18. The ram 16 is provided at its upper end with a head 19 which is supported on the plate 17 by means of a compression spring 20.

Figure 4:
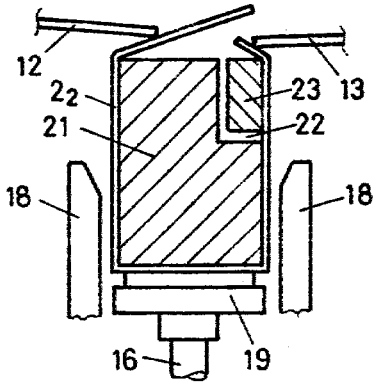
FIG. 4 is a sectional view of a component shown in FIG. 2, but depicted in a different operational phase.

Upon upward movement of the tube 15, first the folder panels 18 and immediately thereupon, the head 19 engage the blank $2_1$. The head 19 presses the blank in an elastically yielding manner against the underside of an elongated, horizontally oriented stationary mandrel 21. At the same time, the folder panels 18 fold the blank $2_1$ at opposite sides, in cooperation with the respective mandrel sides. The stroke of the folder panels 18 is designated at h in FIG. 2. FIG. 4 illustrates how the head 19 holds the blank $2_2$ against the underside of the mandrel 21. Subsequently, the arms 10 and 11 are pivoted upwardly and inwardly, thus folding the blank over the top face of the mandrel. A recess 22 of rectangular cross-sectional outline is provided in an upper corner zone of the mandrel 21, along the entire length thereof. A countershoe 23 is received in the recess 22 along its entire length. The countershoe 23 is movable independently from the mandrel 21 in the longitudinal direction and complements the profile of the mandrel 21 into continuous top and lateral folder surfaces. A longitudinal pressing shoe 24 subsequently presses the now overlapping edge zones of the blank $2_2$ against the upper face of the countershoe 23 as it may be particularly well observed in FIG. 2. One of the edge zones of the blank is provided with an adhesive or a sealing material such as glue or hot melt, so that the overlapping edge zones are firmly bonded to one another by the pressure exerted by the cooperating pressing shoes 23 and 24. In this phase the blank is designated at $2_3$ in FIG. 2.

The prismatic sleeve $2_3$ has to be subsequently stripped from the mandrel 21. For this purpose the pressing shoes 23 and 24 which hold firmly the sleeve $2_3$, are shifted as a unit in the longitudinal direction relative to the mandrel 21 as it will be described below in greater detail. The pressing shoes 23 and 24 carry the sleeve $2_3$ with them as they are longitudinally shifted.

The horizontally oriented elongated mandrel 21 is secured at its left end (as viewed in FIG. 1) to a carrier 25 which is fixedly secured to the machine frame. A support bracket 26 which is mounted on the carrier 25 and an only partially shown other support bracket 27 hold a guide rod 28 at its two ends. A carriage 29 is slidably mounted on the guide rod 28 which has a rectangular cross-sectional outline cooperating with a correspondingly shaped opening in the carriage thus preventing a pivotal motion of the carriage 29 about the rod 28.

There is further provided an L-shaped component 30 which has a vertical leg 31, the upper end of which is secured to the carriage 29. The other, horizontal leg of the L-shaped component 30 constitutes the countershoe 23 which extends in the recess 22 and which tapers slightly in the direction of its free end. The countershoe 23 extends substantially parallel to the length dimension of the mandrel 21. This arrangement is advantageous, in that it makes possible a short structural length of the apparatus.

The carriage 29 further carries a vertically oriented guide sleeve 32 in which there is slidably held a bar 33. The inner cross-sectional outline of the sleeve 32 and the cross-sectional shape of the bar 33 are such that the bar 33 is prevented from turning with respect to the sleeve 32. The lower end of the bar 33 is articulated to the longitudinal pressing member 24 by means of a joint 34. On the upper end of the bar 33 there is mounted a head 35 which is connected with the sleeve 32 by a powerful tension spring 36 and which carries a roller 37 arranged to travel on a horizontal rail 38. The rail 38 is secured at its ends to two arms 39 (one shown in FIG. 2) which are pivotal as a unit by means of a shaft 40. In FIG. 2, a lower position of the rail 38 is shown in solid lines whereas an upper position of the same, together with the roller 37 and the head 35 is shown in phantom lines at 38', 37' and 35', respectively. The rail 38 is pivoted into the upper position 38' in order to lift the longitudinal pressing member 24 away from the mandrel 21 to thus discontinue its pressing effect, as it will be described below.

On the upper side of the carriage 29 there are provided two eyelets 41 to which, at 42, there is articulated an actuating bar 43 with the aid of which the carriage 29 may be reciprocated on the guide rod 28.

When the folding operation performed on a blank $2_2$ reaches approximately the phase shown in FIG. 4, the rail 38 which is then in its upper position 38' is pivoted downwardly (that is, the arms 39 are swung clockwise as viewed in FIG. 2), whereupon the bar 33 can be shifted by the spring 36 in the downward direction, as a result of which the longitudinal pressing member 24 presses the overlapping edge zones of the blank against the countershoe 23. In response to this pressing force, the countershoe 23 yields slightly; the longitudinal pressing member 24 can, by virtue of the articulation 34, readily follow the yielding motion of the countershoe 23. In this position of the bar 33, the roller 37 is still at a small distance from the rail 28 which is in its lower position, so that the rail 28 does not obstruct the compression of the pressing shoes 23 and 24 to one another.

Figure 3:
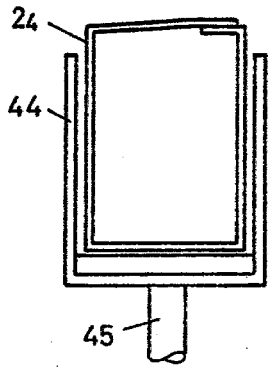
FIG. 3 is an end elevational view of a component taken in the direction of the arrow III of FIG. 1.

Subsequently, the carriage 29 is displaced forwardly (that is, towards the right as viewed in FIG. 1) by means of the rod 43. Thus, as a result, the pressing shoes 23, 24 are likewise shifted, in their state pressed to one another, in the forward direction relative to the mandrel 21. The sleeve $2_3$ is thus carried by the pressing shoes 23 and 24 engaging it at its overlapping edge zones into the position $2_4$, thus stripping the sleeve from the mandrel 21. Since the sleeve $2_3$ is very firmly grasped by the shoes 23, 24 over a relatively large surface, there is no danger that the friction between the sleeve and the mandrel 21 cannot be overcome or that local ruptures in the blank will occur. As the carriage 29 reaches its forward end position 29', the sleeve is displaced into a position $2_4$ in which it is accommodated in a U-shaped receiver 44 (also shown in FIG. 3) which is mounted on a stand 45.

Thereafter the rail 38 is pivoted into its upper position 38', whereby the bar 33 with the longitudinal pressing shoe 24 is pulled upwardly against the force of the spring 36 and thus the sleeve $2_4$ is released from the pressure of the pressing shoes 23 and 24.

Subsequently, as the carriage 29 is pulled back towards the left into its earlier initial position, the roller 37' rolls along the rail 38' and thus maintains the bar 33 in its upper position. After the pressing shoes 23, 24 release the packaging sleeve $2_4$, a grasping device 46 is actuated for gripping a lateral wall of the packaging sleeve $2_4$ for pulling the same from the U-shaped receiver 44 to thus advance the sleeve to additional, non-illustrated conveying arrangements. Since between the sleeve $2_4$ and the receiver 44 no adhesion is present with the exception of the slight friction of the sleeve $2_4$ generated by its own weight, the tongue 46 needs to exert only a slight force which in no way threatens damage to the sleeve $2_4$.

It is to be noted that the setting of the adhesive, which begins in the folded position $2_3$ of the blank, occurs preponderantly during the conveyance of the blank into its free position $2_4$; this circumstance results in a much more rapid operation of the apparatus than in prior art arrangements for making packaging sleeves.

The adhesive may be applied as early as during the making of the blank 2 along one or both edge zones to be bonded to one another. It is, however, feasible to apply the adhesive by the above-described apparatus. For this purpose, on the carrier 25 there is mounted an adhesive container 47 which, at is lower portion, is provided with a dispensing nozzle 48 by means of which an edge zone of the blank 2 is, during its advance effected by the rollers 3, provided with an adhesive such as heated "hot melt". The adhesive cools (sets) during the described operation and effects a bond between the overlapping edge zones of the packaging sleeve.

It is further noted that the free end $23_2$ of the countershoe 23 is situated in the same region of the overlapping edge zones of the blank $2_2$ as the free end $21_2$ of the mandrel 21, as shown in FIGS. 1 and 4. Such an arrangement is advantageous, because if the vertical leg 31 of the L-shaped component 30 is arranged in the zone of the free mandrel end $21_2$, the path of the carriage 29 would have to be made much larger in order to laterally push away the sleeve $2_4$ released by the pressure shoes 23, 24, to thus clear the way for the return motion of the pressing shoes 23 and 24.

It is further advantageous to provide the pressing shoe 24 with an elastic element such as a rubber layer.

Figure 5:
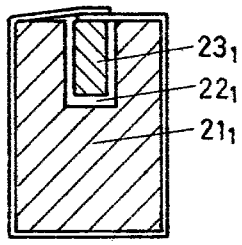
FIG. 5 is a sectional elevational end view of a modification of the component shown in FIGS. 2, 3 and 4.

Turning now to FIG. 5, there is illustrated a variant $21_1$ of the mandrel which in part corresponds to the structure shown in FIG. 4. The recess $22_1$ is, however, not provided along an upper mandrel edge as it was the case in the embodiment described before, but is arranged to extend longitudinally approximately in the middle of the upper surface of the mandrel $21_1$. The groove-like recess $22_1$ and the countershoe $23_1$ shiftable therein have, as in the previously described embodiment, a rectangular cross section, whereby the longer side of the rectangle is oriented vertically in order to ensure a large resistance torque thus ensuring only slight bending deformation. The embodiment shown in FIG. 4 would in most cases be the preferred structure, since the middle of the upper side wall of the packaging sleeve is then not interrupted by the overlapping edge zones. A provision of offset overlap as results from the FIG. 4 structure is advantageous regarding the application of prints (texts or designs) on the sleeve.

The mandrel and the countershoe extending in the recess of the mandrel need not necessarily complement each other to a rectangular profile. Such a profile in principle may be of any polygonal shape or maybe even of rounded configuration. It is to be understood that the blanks advanced into the apparatus may be provided with score lines and slots so that a bottom and a lid may be readily obtained by folding the end flaps of the sleeve $2_4$.

FIGS. 1 and 2 further schematically show the drives of shafts 9 and 40, the ram 15 and the actuating rod 43 as well as the synchronization between these drives. Each drive comprises a respective cam disc 50*a*, 51*a*, 52*a*, and 54. The cam discs 50*a* to 53*a* are provided at their radial faces with a respective cam track which, by means of follower rollers, displace respective levers 50*b*, 51*b*, 52*b* and 53*b*. The latter move the respective shafts 9 and 40 as well as the actuating rod 43. The drive of ram 15 includes the cam disc 54, the camming periphery of which cooperates with a slide plate 55, fixedly mounted on the ram 15. Thus, the cam disc 54 causes the plate 55 to follow its circumference thereby lifting ram 15 which is lowered due to his own weight or if necessary, by means of a spring (not shown).

The synchronization between the different drives is obtained by a common driving shaft 56 shown in broken lines for all cam discs 50*a* to 53*a* and 54. It is noted that, particuarly in FIG. 2, the shaft 56 is shown to be multidirectional solely for purposes of the schematic illustration from which conventional push rods, linkages, plungers and similar driving elements are omitted for the sake of simplicity.

It is to be understood that the above description of the present invention is susceptible to various modifications, changes and adaptations and the same are intended to be comprehended within the meaning and range of equivalents of the appended claims.

What is claimed is:

1. In an apparatus for making a packaging sleeve from a sheet blank, including a mandrel having a length dimension; folder means for wrapping the sheet blank about the mandrel, whereby opposite free longitudinal edge zones of the blank are brought into an overlapping relationship on the mandrel; pressing means for pressing and bonding the overlapping edge zones to one another for obtaining a seam along the length dimension of the packaging sleeve; the improvement wherein said mandrel has a recess extending in said length dimension; said pressing means comprises an elongated first pressing shoe arranged to be receivable in said recess and to be displaceable in its length dimension parallel to the length dimension of said mandrel; said first pressing shoe having at least one face that complements a face of said mandrel into a substantially continuous folder face; said pressing means further including a second pressing shoe arranged to cooperate with said first pressing shoe for pressing overlapping edge zones of the blank sheet to one another; said pressing means further comprising shoe moving means connected to said first and second pressing shoes for displacing said second pressing shoe towards or away from said first pressing shoe into a pressing state and a relased state, respectively, and for shifting said first and second pressing shoes as a unit relative to said mandrel and parallel to the length dimension thereof for stripping the packaging sleeve from said mandrel with said first and second pressing shoes.

2. An apparatus as defined in claim 1, wherein said mandrel has a rectangular cross-sectional outline when viewed together with the cross-sectional outline of said recess; said recess extending in a corner zone of said mandrel.

3. An apparatus as defined in claim 1, wherein said mandrel has a rectangular cross-sectional outline when viewed together with the cross-sectional outline of said recess; said recess extending in a face of said mandrel spaced from corner zones thereof.

4. An apparatus as defined in claim 1, wherein said mandrel is stationarily supported in said apparatus and having a free end; further wherein said shoe moving means comprises a carriage arranged spaced from said mandrel and displaceable parallel to the length dimension of said mandrel; further comprising an angled member having a first leg constituting said first pressing shoe; said first pressing shoe having a free end and being at least approximately parallel to the length dimension of said mandrel; said angled member having a second leg attached to said carriage such that said free ends of said mandrel and said first pressing shoe are situated in the same region of the overlapping edge zones of the blank sheet.

5. An apparatus as defined in claim 4, wherein said first pressing shoe tapers towards its free end and further wherein said first pressing shoe has a rectangular cross-sectional shape of short and long sides; one of said short sides forms a work face cooperating with said second pressing shoe.

6. An apparatus as defined in claim 1, wherein said shoe moving means comprises (a) a first guide rail extending spaced from said mandrel and parallel to the length dimension thereof;

(b) a carriage mounted on said first guide rail for displacement therealong; said first pressing shoe being attached to said carriage;

(c) a shoe holding member attached to said second pressing shoe;

(d) mounting means attached to said carriage and coupling said shoe holding member to said carriage; said mounting means providing for a displaceability of said shoe holding member and said second pressing shoe towards and away from said first pressing shoe;

(e) means for urging said second pressing shoe into said pressed state;

(f) a movably supported second guide rail extending parallel to and spaced from said first guide rail and being operatively connected with said shoe holding member; said second guide rail having a first position in which it maintains said second pressing shoe in said released state and a second position in which said second pressing shoe is maintained in said pressed state;

(g) first force-exerting means for shifting said carriage along said first guide rail; and (h) second force-exerting means for moving said second guide rail into its said first and second positions.

7. An apparatus as defined in claim 6, further comprising a roller mounted on said shoe holding member and arranged for a rolling engagement with said second guide rail for establishing an operative connection between said shoe holding member and said second guide rail.

8. An apparatus as defined in claim 6, wherein said mandrel is stationarily supported in said apparatus.

9. An apparatus as defined in claim 6, wherein said second pressing shoe is articulated to said shoe holding member.

10. An apparatus as defined in claim 6, wherein said shoe holding member comprises a holding bar.

11. An apparatus as defined in claim 10, wherein said mounting means comprises a sleeve through which said bar slidably passes.

12. An apparatus as defined in claim 6, wherein said means for urging said second pressing shoe into said pressed state comprises a spring.

13. An apparatus as defined in claim 12, wherein said spring is attached to said shoe holding member and said mounting means.

* * * * *